United States Patent [19]

Funabashi

[11] Patent Number: 4,771,609

[45] Date of Patent: Sep. 20, 1988

[54] ICE MAKING MACHINE

[75] Inventor: Takeaki Funabashi, Toyoake, Japan

[73] Assignee: Hoshizaki Electric Co., Ltd., Toyoake, Japan

[21] Appl. No.: 59,856

[22] Filed: Jun. 1, 1987

[51] Int. Cl.[1] ..... F25C 1/14

[52] U.S. Cl. ..... 62/137; 62/344; 62/354

[58] Field of Search ..... 62/137, 344, 354

[56] References Cited

U.S. PATENT DOCUMENTS

| | | | |
|---|---|---|---|
| 2,877,632 | 3/1959 | Chaplik et al. | 62/344 X |
| 3,196,628 | 7/1965 | Reynolds | 62/354 X |
| 3,377,815 | 4/1968 | Soderberg | 62/354 X |
| 3,406,529 | 10/1968 | Stokes, III | 62/354 X |
| 3,511,059 | 5/1970 | Hoenisch | 62/354 X |
| 3,769,809 | 11/1973 | Robinson et al. | 62/354 X |
| 3,877,241 | 4/1975 | Wade | 62/344 X |
| 4,104,889 | 8/1978 | Hoenisch | 62/344 X |
| 4,276,750 | 7/1981 | Kawasumi | 62/354 X |
| 4,328,681 | 5/1982 | Sakamoto et al. | 62/354 X |

*Primary Examiner*—William E. Tapolcai

*Attorney, Agent, or Firm*—Wenderoth, Lind & Ponack

[57] ABSTRACT

An auger type ice making mahine has a refrigerator, an ice making cylinder for forming a layer of ice in cooperation with the refrigerator, and a top ice storage chamber in communication with the ice making cylinder for storing ice discharged therefrom. A bottom ice storage chamber is disposed below the top ice storage chamber for receiving and storing ice transferred from the top ice storage chamber. The top ice storage chamber is equipped with a top ice storage level detector for detecting the amount of ice stored within the top chamber, an ice dispensing gate mechanism capable of dispensing ice pieces stored in the top ice storage chamber outwardly therefrom, and an ice transfer system capable of transferring ice pieces from the top ice storage chamber to the bottom ice storage chamber. The bottom ice storage chamber is provided with a bottom ice storage level detector for detecting the amount of ice stored within the bottom chamber. The refrigerator is stopped by the top ice storage detector when a predetermined amount of stored ice is detected. The ice transfer system is controlled so as to be released from the operating state by the bottom ice storage level detector when a predetermined amount of stored ice within the bottom chamber is detected.

6 Claims, 3 Drawing Sheets

ICE MAKING MACHINE

BACKGROUND OF THE INVENTION

1. Field of the Invention

The present invention relates to an auger-type ice making machine in which an ice layer formed on an inner surface of an ice making cylinder wound with a vaporizing pipe is scraped off by an auger screw, wherein resulting ice fragments are compressed into small solidified ice pieces. More particularly, the present invention is directed to an ice storage system for storing the ice pieces produced by the ice making machine.

2. Description of the Prior Art

In a known auger-type ice making machine such as the one shown in FIG. 7 of the attached drawings, an ice layer is formed on an inner surface of an ice making cylinder 2 by a refrigerator which is operatively associated with the ice making cylinder 2 and includes a compressor, a condenser, a vaporizer and other refrigerator elements in an arrangement known per se. The ice layer thus produced is scraped off by means of an auger screw (not shown) rotationally driven by a drive motor 5. The resulting ice fragments are fed upwardly through compressing channels (not shown) to an ice storage chamber or box 4 disposed above the ice making cylinder 2. In the known ice making machine, only one ice storage chamber or box 4 is installed, having a storage capacity as low as 1 to 4 kg. For this reason, the ice making machine is primarily intended for use in producing small ice pieces to be put in a cup or the like through an ice dispensing device 3 for supplying cold water. Thus, the ice stocker 4 is designed to be capable of repeatedly delivering a small volume of ice pieces a number of times when required.

Because the prior art auger-type ice making machine is intended primarily for applications in which a small number of ice pieces is delivered time after time and has relatively small storage capacity, the prior art ice making machine can not supply a large amount of ice which is disadvantageous.

The disadvantage discussed above may be overcome by making use of the daily output capability of the ice making machine itself fully and effectively and increasing the storage capacity of the ice storage chamber correspondingly. However, an increased storage capacity requires a correspondingly increased height in the ice making machine as a whole, increasing the danger that the machine might fall over under the influence of some external forces such as earthquakes. Additionally, an agitator which is rotatably mounted within the ice storage chamber which not only prevents a so-called arching phenomenon in which ice pieces bond together in a bridge-like configuration but also aids in discharging ice pieces from the ice storage box becomes bulky and correspondingly heavy, which in turn means that the torque necessary to rotate the agitator is must also be increased. Consequently, not only does the mechanical strength of the agitator have to be increased but also the rated power of the drive motor 5 for driving the agitator has to be increased. Furthermore, in order to deliver a large amount of ice pieces, the opening of the ice dispensing device 3 as well as the dispensing or exit port 6 should preferably be enlarged. However, when it is desired that the ice making machine also be capable of repeatedly delivering ice pieces bit by bit, an agitator which performs a function of aiding the discharge of ice pieces as mentioned above will have to be a specifically designed structure which is naturally more complicated. In this way, any attempts to simply increase the capacity of the ice storage chamber are accompanied with the difficulties mentioned above. Consequently, even if a refrigerator having a high daily output capability is employed, limitations are still imposed on the ice storage capacity, which in turn presents an obstacle to the effective use of the refrigerator output capability. Thus, the known auger-type ice making machines are disadvantageous in that such can not supply large amounts of ice.

SUMMARY OF THE INVENTION

Accordingly, it is an object of the present invention to provide an auger-type ice making machine which eliminates the shortcomings of the prior art auger-type ice making machines and which is capable of storing a large volume of ice without being relatively high or having relatively high center of gravity while allowing the ice pieces to be dispensed or repeatedly delivered in small volumes a number of times as in the case of the known machine.

In view of the above-described object, there is provided according to an aspect of the present invention an auger-type ice making machine which includes in addition to a top ice storage chamber or box, a bottom ice storage chamber or box for receiving and storing therein ice pieces discharged and fed from the top ice storage box, wherein the top ice storage box is provided with ice-piece dispensing means capable of repeatedly dispensing a small amount of ice a number of times and ice-piece transferring means for discharging the ice pieces from the top ice storage box into the bottom ice storage box. Additionally, the top and bottom ice storage boxes are equipped with ice storage level detectors, respectively, wherein the refrigerator is controlled by the top ice storage level detector, while the ice transfer means is controlled by the bottom ice storage level detector.

In the above-mentioned structure of the auger-type ice making machine according to the present invention, when the amount of ice pieces stored within the top ice storage box becomes smaller than a predetermined value or level, this situation is instantaneously detected by the top ice storage level detector, whereby a signal is issued to command the refrigerator to start the ice making operation. The ice pieces produced by the ice making cylinder of the refrigerator are then fed to the top ice storage box to be temporalily stored therein from where they can be repeatedly dispensed outwardly bit by bit a number of times as required by actuating the ice dispensing means.

On the other hand, when the bottom ice storage box is empty while the top ice storage box stores ice pieces in a volume greater than the predetermined level, the bottom ice storage level detector produces a corresponding signal, in response to which the ice-piece transferring means is actuated to open a transfer passage extending between the top ice storage box and the bottom ice storage box, whereby an amount of excess ice pieces is discharged from the top ice storage box to the bottom ice storage box. When a predetermined amount of ice pieces is stored in the bottom ice storage box in this manner, the bottom ice storage level detector produces a signal which causes the ice-piece transferring system to close the aforementioned passage.

When the amount of ice stored in the top and bottom storage chambers attains or exceeds a predetermined total amount of ice, the refrigerator stops its operation in response to signals produced by the top and bottom ice storage level detectors.

BRIEF DESCRIPTION OF THE DRAWINGS

In the course of the following detailed description, reference will be made to the attached drawings, in which.

DESCRIPTION OF THE PREFERRED EMBODIMENTS

Figure 1:
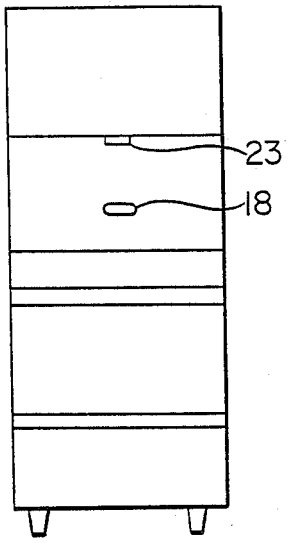
FIG. 1 is a front view showing schematically a beverage dispenser in which an auger-type ice making machine according to an exemplary embodiment of the present invention is incorporated.
Figure 2:
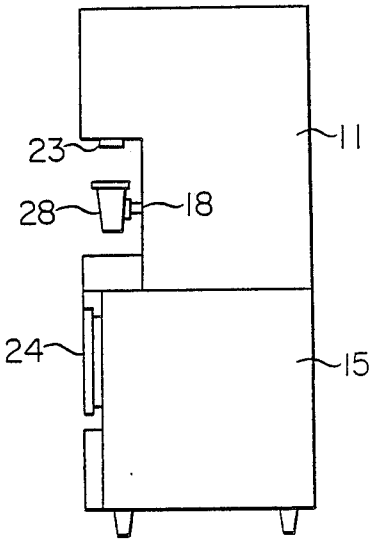
FIG. 2 is a side view of the beverage dispenser shown in FIG. 1.
Figure 3:
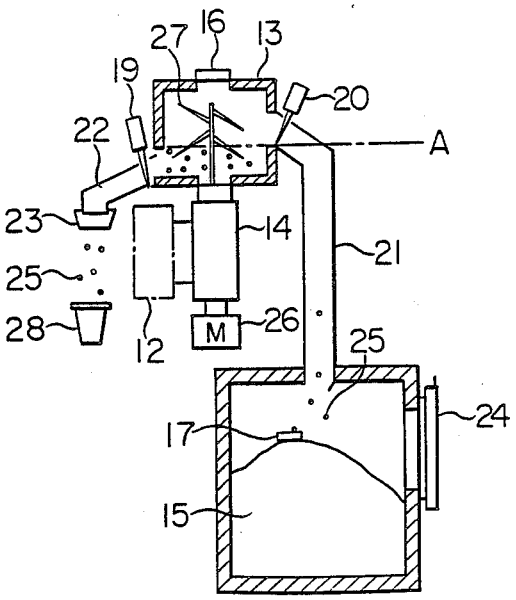
FIG. 3 is a partial side sectional view showing, the ice making machine according to an embodiment of the invention accommodated within the beverage dispenser shown in FIG. 1.

Referring to the drawings and in particular to FIGS. 1 to 3, a beverage dispenser for delivering a beverage with ice pieces and an auger type ice making machine accommodated within the dispenser housing according to an embodiment of the present invention is schematically shown. In these figures, reference numeral 11 denotes a main body of the beverage dispenser having a refrigerator 12 comprising a known construction disposed therein. A top ice storage box 13 comprising a heat-insulated structure is preferably disposed above an ice making cylinder 14 wound with a vaporizing pipe (not shown) of the refrigerator 12 and serves to store ice pieces therein that have been discharged from the ice making cylinder 14. A bottom ice storage box 15 is disposed beneath the top ice storage box 13 for receiving ice pieces therefrom. The bottom ice storage box 15 comprises a heat-insulated structure and has a greater storage capacity than that of the top ice storage box 13. A top ice storage level detector 16 is disposed on the top ice storage box 13 for detecting the amount of ice pieces stored therein. Similarly, a bottom ice storage level detector 17 is installed in the bottom ice storage box 15 for detecting the amount of ice pieces stored therein. The top ice storage level detector 16 and the bottom ice storage level detector 17 may be conventional level detectors. Reference numeral 18 denotes an ice piece dispensing switch, under the command of which an ice dispensing or delivering mechanism 19 is actuated for dispensing ice pieces from the top ice storage chamber 13 in a small amount a number of times as required. Furthermore, reference numeral 20 denotes an ice-piece downward transferring mechanism which is actuated in response to output signals of the bottom ice storage level detector 17 to open or close a down-chute 21 through which the top ice storage box or chamber 13 communicates with the bottom ice storage chamber 15. Both the ice discharging mechanisms 19 and the downward transferring mechanism 20 are associated with the top ice storage box 13. In this respect, it is to be noted that the ice downward discharging or transfer mechanism 20 for opening and closing the down-chute 21 is disposed at a location slightly higher than the ice-piece delivering or dispensing mechanism 19. An ice dispensing chute 22 dispenses the ice pieces from the top ice storage box 13 in small amounts as required via actuation of the ice dispensing mechanism 19 and has an ice exit port 23 mounted on the ice dispensing chute 22 at the free end thereof, the exit port 23 opening to the exterior of the ice dispenser. Reference numeral 24 denotes a door mounted to open and close the bottom ice storage box 15 for allowing access to the interior thereof to take out ice pieces. Reference numeral 25 denotes ice pieces, and numeral 26 denotes a drive motor for driving an auger screw (not shown) disposed within the ice making cylinder 14. Finally, reference numeral 27 denotes an agitator rotatably driven by the drive motor 26.

In the illustrated embodiment, the ice dispensing mechanism 19 for dispensing ice pieces and the ice-piece discharging or transferring mechanism 20 for transferring ice pieces to the bottom ice storage box 15 are each comprised of a gate solenoid valve adapted to be opened and closed through activation or deactivation of an associated solenoid coil by a relay. When the agitator 27 is rotated with the ice dispensing/transferring gate mechanisms 19 and/or 20 being open, the ice pieces within the top ice storage box 13 are dispensed therefrom toward the ice dispensing exit 23 and/or transferred to the bottom ice storage box 15 due to the inherent ice discharging function of the agitator 27. It should be mentioned that the structure of the ice dispensing/discharging gate mechanisms 19 and 20 and the agitator per se are known.

Figure 4:
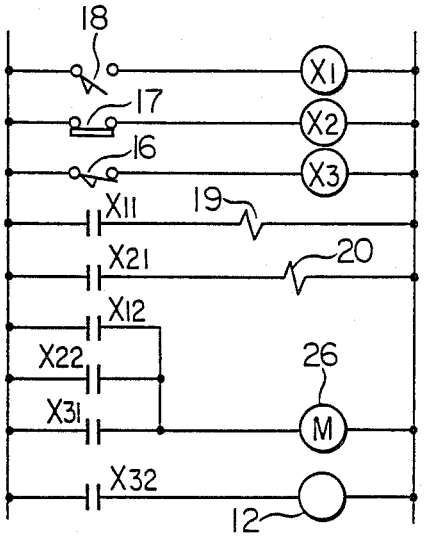
FIG. 4 illustrates an example of an electric circuit which can be incorporated in the beverage dispenser shown in FIG. 1.

Next, an electric circuit incorporated in the auger type ice making machine described above will be described. Referring to FIG. 4, relays $X_1$, $X_2$ and $X_3$ are connected in series to the ice piece dispensing switch 18, the bottom ice storage level detector 17 and the top ice storage level detector 16, respectively. The relay $X_1$ has a normally open contact $X_{11}$ connected in series to the ice dispensing gate mechanism 19 and another normally open contact $X_{12}$ which is connected in series to the drive motor 26. On the other hand, the relay $X_2$ has a normally open contact $X_{21}$ connected in series to the ice transferring gate mechanism 20 and another normally open contact $X_{22}$ which is connected in parallel with the contact $X_{12}$ and in series to the drive motor 26. Furthermore, the relay $X_3$ has a contact $X_{31}$ connected in parallel with the contacts $X_{12}$ and $X_{22}$, respectively, and in series to the drive motor 26. The other contact $X_{32}$ of the relay $X_3$ is connected in series to the refrigerator 12.

During operation, unless the level of the ice pieces 25 stored within the bottom storage box 15 attains a predetermined level, the bottom ice storage level detector 17 responds to the detected startus by closing an output contact thereof, whereby an output signal is produced, in response to which the relay $X_2$ is energized. Thus, the contacts $X_{21}$ and $X_{22}$ are closed to activate the ice-piece transfer gate mechanism 20 and the drive motor 26, respectively. In that case, however, unless the mass of ice pieces 25 stored within the top ice storage box 13 exceeds a predetermined or preset level indicated by a line A, i.e. when the mass of ice pieces 25 lies below the level at which the ice pieces can be discharged downwardly to the bottom ice storage box 15 through the down-chute 21, the ice pieces produced are stored only within the top ice storage box 13 without being transferred to the bottom storage box 15 through the down-chute 21. Only when the level of ice pieces thus accumulated in the top ice storage box 13 exceeds the reference level indicated by the line A, are the ice pieces then transferred to the bottom ice storage box 15 through the discharge gate mechanism 20, which is opened at that time, and the down-chute 21.

When the ice pieces 25 fed to the mass of bottom storage box 15 has attained a predetermined level of storage, the bottom ice storage level detector 17 responds by opening the output contact thereof, the result of which is that the relay $X_2$ is de-energized, whereby the associated contacts $X_{21}$ and $X_{22}$ are opened, which in turn results in the closing of the ice-piece transfer gate mechanism 20. However, since the output contact of the top ice storage level detector 16 of the top ice storage box 13 is closed, the associated relay $X_3$ continues to remain in the energized state with the contacts $X_{31}$ and $X_{32}$ thereof being in the closed state. Consequently, the drive motor 26 and the refrigerator 12 continue to operate, whereby the ice pieces are continuously produced to be stored within the top storage box 13.

When the mass of ice pieces 25 stored within the top ice storage box 13 has obtained a predetermined volume so as to extend above the level represented by the line A, this is detected by the top ice storage level detector 16, resulting in the relay $X_3$ being de-energized to open the contacts $X_{31}$ and $X_{32}$ thereof. As a consequence, the drive motor 26 and the refrigerator 12 is stopped, whereby the ice making operation are interrupted.

In this manner, by virtue of such an arrangement in which the refrigerator 12 is controlled by the top ice storage level detector 16 while the ice-piece transfer gate mechanism 20 for allowing ice pieces 25 to be discharged to the bottom ice storage box 15 is controlled by the bottom ice storage level detector 17, a decrease in the volume of ice pieces 25 stored within the bottom ice storage box 15 below a predetermined level due to consumption of the ice pieces results in the closing of the output contact or a generation of the corresponding output signal of the bottom ice storage level detector 17, whereupon the relay $X_2$ is energized with the relay contacts $X_{21}$ and $X_{22}$ being closed to thereby activate the drive motor 26. Additionally, the ice transfer gate mechanism 20 is opened to allow ice pieces 25 to be fed through the down-chute 21 to the bottom ice storage box 15 to be stored therein. When the level of ice pieces within the top ice storage box 13 subsequently decreases below the predetermined level A, the top ice storage level detector 16 responds thereto by closing the output contact, which in turn results in the relay $X_3$ being energized with the associated contacts $X_{31}$ and $X_{32}$ being closed to thereby activate the drive motor 26 and the refrigerator 12, whereupon the ice making process is restarted.

The supply or dispensing of a small amount of ice pieces 25 to a cup 28 or the like is effected by pushing the ice-piece dispensing switch 18. More specifically, when this switch 18 is closed, the relay $X_1$ is energized with the associated contacts $X_{11}$ and $X_{12}$ being closed, whereby the drive motor 26 is activated. Consequently, the ice dispensing gate mechanism 19 is opened to thereby allow the ice pieces 25 to be dispensed to the cup 28 or the like through the dispensing chute 22 and the exit port 23.

When the ice dispensing switch 18 is released, the switch contact thereof is opened, resulting in the relay $X_1$ being de-energized with the associated contacts $X_{11}$ and $X_{12}$ being opened. As the result, the ice dispensing gate mechanism 19 is closed to stop dispensing ice pieces 25. A corresponding decrease in the amount of the ice pieces 25 within the top ice storage box 13, brought about by the dispensing operation, is monitored by the top ice storage level detector 16. When the latter detects that the level of ice pieces 25 within the top storage box 13 has decreased below the predetermined level typified by the line A, the output contact of the top ice storage level detector 16 is closed, whereby the relay $X_3$ is energized with the associated contacts $X_{31}$ and $X_{32}$ being closed to allow the drive motor to continue running, while the refrigerator 12 is activated to start the ice making operation.

It is to be noted that so long as the drive motor 26 is running, the agitator 27 disposed within the top ice storage box 13 is also operated to prevent the arching phenomenon from occurring within the top ice storage box while aiding in discharging ice pieces 25.

It should be added that ice pieces 25 within the bottom storage box 15 can be taken out at any time by opening the door 24.

In the embodiment described above, the availability of ice pieces 25 within the top storage box 13 is an important factor. More specifically, unless ice pieces 25 within the top storage box 13 are consumed by dispensing them through manipulation of the dispensing switch 18, the ice pieces 25 are constantly available within the top storage box 13 in a volume at least extending to the minimum storage level A. Thus, the top ice storage box 13 is maintained in a state in which ice pieces 25 can always be dispensed from the exit port 23 by operating the dispensing switch 18.

Figure 5:
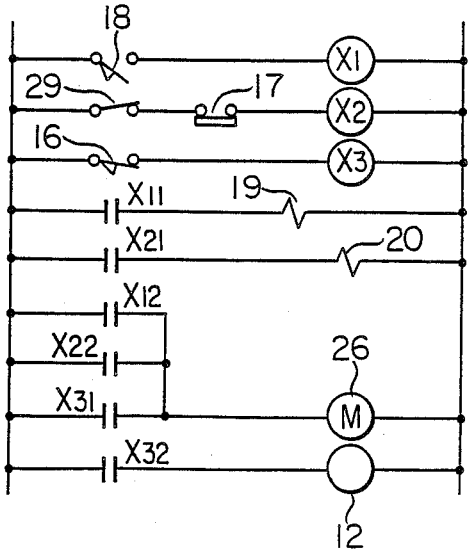
FIG. 5 illustrates an electric circuit having a change-over switch added to the electric circuit shown in FIG. 4.

Referring to FIG. 5 which shows a modification of the electric circuit shown in FIG. 4, a change-over switch 29 is additionally provided in serial connection to the bottom ice storage level detector 17 for the purpose of selectively allowing ice pieces 25 to be stored in the bottom storage box 15 or alternatively inhibiting such storage. When the bottom ice storage level detector 17 is constantly set to the off-state (open state) by means of this switch 29, the top storage box 13 can always contain an amount of ice pieces 25 which exceeds the minimum volume indicated by the line A. This means that ice pieces 25 within the top storage box 13 can be transferred to the bottom storage box 15 whenever required, whereby the entire volume of ice pieces stored in the system can be controlled such that a desired volume of ice pieces is always available.

Figure 6:
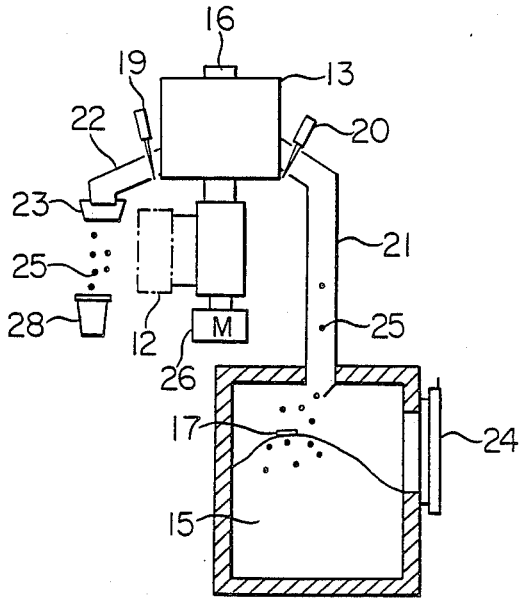
FIG. 6 is a partial side sectional view showing, an auger-type ice making machine according to another embodiment of the present invention.
Figure 7:
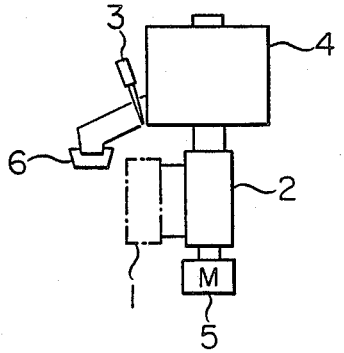
FIG. 7 (PRIOR ART)
FIG. 7 is a schematic side view illustrating a general arrangement of a known auger-type ice making machine.

When the electric control circuit arrangement shown in FIG. 5 is adopted, the ice making and dispensing machine can take the form shown in FIG. 6, in which the ice piece dispensing gate mechanism 19 for delivering or dispensing ice pieces 25 from the exit port 23 is disposed at the same height as the ice-piece transfer gate mechanism 20 for transferring ice pieces 25 to the bottom storage box 15. In the structure shown in FIG. 6, however, the top ice storage box 13 may become completely exhausted of ice pieces, thereby rendering it impossible to deliver ice pieces through the exit port 23 even when the dispensing switch 18 is actuated.

As will now be appreciated from the foregoing description, the provision of a bottom ice storage chamber having a large capacity according to the teaching of the invention allows the ice storing capacity to be increased while stabilizing the center of gravity of the machine, a demand for the supply of a large amount of ice pieces can be successfully handled. Additionally, the provision of the ice piece dispensing gate mechanism in combination with the downward transfer system allows ice pieces to be repeatedly dispensed to cups or the like in small amounts. Besides, the ice pieces within the bottom storage box can be utilized for cooling a cooler containing carbonated beverages or a mineral water dispenser as well as for cooling canned or bottled beverages.

Moreover, by virtue of the arrangement in which the refrigerator is controlled by the top ice storage level detector while the ice-piece downward transferring system is controlled by the bottom ice storage level detector and in which ice pieces within the top ice storage box can be transferred to the bottom ice storage box through the downward transfer system, the storage of ice pieces within the bottom storage box can be automatically controlled. This feature is an important contribution to the effective capability of the ice making machine.

In the modified embodiment in which the change-over switch 29 is provided (FIG. 5), any required amount of ice pieces can be made available in the bottom ice storage chamber at any time so long as ice pieces within the top ice box are not exhausted. This feature is advantageous from an economical viewpoint.

Finally, an additional advantage of the embodiment in which the downward transfer gate mechanism is disposed at a location higher than the ice piece dispensing or delivering gate, a predetermined amount of ice pieces is constantly stored so as to be available within the top storage box, whereby undesirable situations, such as the top ice storage box becoming empty, can be prevented.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An auger-type ice making machine, comprising:

an ice making cylinder having a peripheral inner surface, a refrigerator operatively connected to said ice making cylinder for forming a layer of ice over said peripheral surface;

a top ice storage chamber having a generally cylindrical peripheral wall with first and second openings extending therethrough, said top ice storage chamber operatively connected to said ice making cylinder for receiving ice therefrom and for storing the ice received;

agitating means extending substantially vertically within said top ice storage chamber for agitating the ice stored therein;

a bottom ice storage chamber disposed below said top ice storage chamber and in communication therewith via said second opening for receiving ice from said top ice storage chamber and for storing the ice received;

said top ice storage chamber having top ice storage detecting means for detecting the amount of ice stored in said top ice storage chamber, ice dispensing means disposed over said first opening of the top ice storage chamber and comprising a solenoid operated gate valve for assuming an open state at which the stored ice in the top ice storage chamber can be dispensed through said first opening, and ice transfer means disposed over said second opening of the top ice storage chamber and comprising a solenoid operated gate valve for assuming an open state at which the stored ice in the top ice storage chamber can be transferred through said second opening to said bottom ice storage chamber and a closed state at which the stored ice in the top ice storage chamber can not be transferred to said bottom ice storage chamber;

said bottom ice storage chamber having bottom ice storage detecting means for detecting the amount of ice stored in said bottom ice storage chamber; and control means operatively connected to said refrigerator and said top ice storage detecting means for stopping the operation of the refrigerator when said top ice storage detecting means has detected a predetermined amount of ice in said top ice storage chamber, said control means also operatively connected to said agitating means and said ice transfer means for causing said agitating means to agitate the ice stored within said top ice storage chamber for transferring ice from said top ice storage chamber to said bottom ice storage chamber through said second opening when said solenoid operated gate valve of said ice transfer means is in the open state thereof, and said control means operatively connected to said bottom ice storage detecting means for switching said solenoid operated gate valve of said ice transfer means from the open state to the closed state thereof when said bottom ice storage detecting means has detected a predetermined amount of ice stored in said bottom ice storage chamber.

2. An auger-type ice making machine as claimed in claim 1, wherein said bottom ice storage chamber has an ice storage capacity that is greater than that of said top ice storage chamber.

3. An auger-type ice making machine as claimed in claim 1, wherein said second opening extends through said peripheral wall of the top ice storage chamber at a location thereon that is at a level disposed above the location at which said first opening extends through said peripheral wall.

4. An auger-type ice making machine as claimed in claim 1, wherein said second opening extends through said peripheral wall of the top ice storage chamber at a location thereon that is substantially level with the location at which said first opening extends through said peripheral wall.

5. An auger-type ice making machine as claimed in claim 1, and further comprising a change-over switch connected in series to said bottom ice storage detecting means for allowing said bottom ice storage detecting means to be switched between an on state at which said bottom ice storage detecting means detects the level of ice stored in said bottom ice storage chamber and an off state at which said bottom ice storage detecting means does not detect the level of ice stored in said bottom ice storage chamber to maintain said solenoid operated gate valve of said ice transfer means in the closed state thereof.

6. An auger-type ice making machine as claimed in claim 1, and further comprising a manually actuatable dispensing switch operatively connected in series to said ice dispensing means for causing said ice dispensing means to assume the open state thereof when said dispensing switch is manually actuated.

* * * * *